US008185985B2

(12) United States Patent
Coffield et al.

(10) Patent No.: US 8,185,985 B2
(45) Date of Patent: May 29, 2012

(54) LOAD BEARING SURFACE

(75) Inventors: Timothy P. Coffield, Grand Rapids, MI (US); Andrew B. Hartmann, Muskegon, MI (US)

(73) Assignee: Illinois Tool Works Inc., Glenview, IL (US)

( * ) Notice: Subject to any disclaimer, the term of this patent is extended or adjusted under 35 U.S.C. 154(b) by 172 days.

(21) Appl. No.: 12/738,791

(22) PCT Filed: Oct. 10, 2008

(86) PCT No.: PCT/US2008/079442

§ 371 (c)(1),
(2), (4) Date: Apr. 19, 2010

(87) PCT Pub. No.: WO2009/055252

PCT Pub. Date: Apr. 30, 2009

(65) Prior Publication Data

US 2010/0243856 A1 Sep. 30, 2010

Related U.S. Application Data

(60) Provisional application No. 60/982,871, filed on Oct. 26, 2007.

(51) Int. Cl.
*A47C 23/02* (2006.01)

(52) U.S. Cl. ..... 5/191; 5/236.1; 5/238; 297/452.63

(58) Field of Classification Search ..... 5/186.1, 5/189, 191, 236.1, 239, 241; 297/452.63; 267/80, 89, 110–112

See application file for complete search history.

(56) References Cited

U.S. PATENT DOCUMENTS

| | | | | |
|---|---|---|---|---|
| 3,427,693 | A * | 2/1969 | Adams | 24/302 |
| 3,636,574 | A * | 1/1972 | Kramer | 5/186.1 |
| 3,737,926 | A * | 6/1973 | Hermanson | 5/191 |
| 3,751,110 | A * | 8/1973 | Shaw | 297/452.63 |
| 3,842,452 | A * | 10/1974 | Kievits | 5/237 |
| 4,106,140 | A * | 8/1978 | Kievits | 5/191 |
| 5,058,223 | A * | 10/1991 | Vasquez | 5/237 |
| 6,060,407 | A | 5/2000 | Skochdopole et al. | |
| 6,082,240 | A | 7/2000 | Middione et al. | |
| 7,441,758 | B2 | 10/2008 | Coffield et al. | |
| 2004/0003467 | A1 * | 1/2004 | Fromme | 5/264.1 |
| 2006/0286359 | A1 | 12/2006 | Coffield et al. | |

OTHER PUBLICATIONS

ISR for PCT/US2008/079442 dated Dec. 8, 2008.

* cited by examiner

*Primary Examiner* — Michael Trettel
(74) *Attorney, Agent, or Firm* — Mark W. Croll; Paul F. Donovan

(57) ABSTRACT

An elastomeric load bearing surface includes an integral attachment mechanism, wherein portions of the load bearing surface attach to each other to secure the load bearing surface to a support structure. In one embodiment, a molded elastomeric strip includes a tab that wraps around a support structure frame member, and a receptacle that receives and retains the first portion. The load bearing surface may be formed from a plurality of molded elastomeric strips, each having a tab extending around the frame member and an opening receiving the tab. The strips may be oriented to reduce creep by aligning the crystalline structure of the elastomer in one direction.

13 Claims, 4 Drawing Sheets

LOAD BEARING SURFACE

CLOSE REFERENCE TO RELATED APPLICATIONS

The present Application is a national phase of International Application Number PCT/US2008/079442, filed Oct. 10, 2008, and claims benefit to United States Provisional Application Ser. No. 60/982,871, filed Oct. 26, 2007, the disclosures of which are hereby incorporated by reference herein in their entirety.

FIELD OF THE INVENTION

The present invention relates to load bearing assemblies, and more particularly to load bearing assemblies for supporting a load bearing surface over an opening with a peripheral frame, such as the seat or back of a chair or bench, or the support surface of a bed, cot or other similar product.

BACKGROUND OF THE INVENTION

There are continuing efforts to develop new and improved load bearing assemblies. In general, the primary objectives of these efforts are to obtain a durable and inexpensive load bearing surface that is relatively easy to manufacture. It is also important to address issues in the attachment of the load bearing surface to the support structure.

It is known to provide molded load bearing surfaces for a wide variety of applications. For example, molded plastic chairs (e.g. lawn chairs) are available from a variety of well known suppliers. Although these molded chairs provide an inexpensive seating option, they typically do not provide the level of support and comfort available in more expensive load bearing surfaces, such as conventional cushion sets. Rather, they provide an essentially linear force/deflection profile, which gives the typical molded seating surface the feel of a drum or a trampoline. In seating and other body-support applications, this may result in an uncomfortable and sometimes ergonomically unacceptable load bearing surface. Further, the ability to tune the characteristics of a conventional molded seat is relatively limited. Different materials and different material thicknesses can be used to provide a limited degree of control over the characteristics of the seat, but this level of control is not sufficient in many applications. In many cases, materials that are thick enough to provide the necessary support are too rigid and uncomfortable, and thinner plastic surfaces, such as membranes or woven plastic fibers tend to permanently deform (or creep) over time.

Recently, as disclosed and described in U.S. Patent Application Publication No. 2006/0267258, filed Jun. 12, 2006, titled "Load Bearing Surface," the subject matter of which is incorporated herein by reference, it has become known to make a strong, yet flexible and comfortable load bearing surface using a molded elastomeric membrane. The molded elastomeric membrane may be decoupled between a first direction and a second direction, by mechanical structure, by orienting the membrane to align the crystalline structure of the elastomeric material in one direction or by some combination of the foregoing. The decoupled elastomeric material exhibits support characteristics that are particularly well suited for use in seating applications because it provides different degrees of support in different directions. Further, by increasing the alignment of the crystalline structure of the elastomeric material, the level of creep in the membrane can be dramatically reduced.

There continues to be a desire, however, for improvements in the attachment of elastomeric load bearing surfaces, and particularly molded elastomeric load bearing surfaces, to a support structure. Of course, screws and other separate fasteners can be used, but they are known to be problematic because of the extra costs associated with additional materials and manufacturing steps, and because they tend to be unattractive. One known method that eliminates the use of separate fasteners includes molding a plurality of receptacle holes in the load bearing surface that align with protrusions on the support frame to snap-fit the elastomeric load bearing surface to the support frame. Another known method includes molding a peripheral portion of the lead bearing surface in situ with a portion of the support frame. Although generally acceptable, these methods can be problematic in situations where the features of the support frame cannot be manipulated as necessary to accommodate or receive attachment features on the load bearing surface. For instance, it can be difficult and costly to create a steel support frame with a plurality of properly spaced apart protrusions extending from it to attach to a load bearing surface.

SUMMARY OF THE INVENTION

The present invention provides an elastomeric load bearing surface with an integral attachment mechanism, wherein portions of the load bearing surface attach to each other to secure the load bearing surface to a support structure. In one embodiment, opposite ends of the load bearing surface each include an integral attachment mechanism so that the load bearing surface can be supported from both ends.

In one embodiment, the present invention includes a molded elastomeric membrane with a first portion that wraps around a support structure frame member, and a second portion that receives and retains the first portion. In one embodiment, the first portion is a tab, and the second portion is a receptacle that receives and retains the tab.

In another embodiment, the molded elastomeric membrane includes a plurality of elastomeric strips. Each strip may include a first attachment portion and a second attachment portion for securing the strip to a support frame member. Each elastomeric strip may also include structure for attaching to another one of the elastomeric strips, such that the plurality of strips can be aligned adjacent to each other and secured together to form the load bearing surface.

In another embodiment, at least a portion of the membrane is oriented to align the crystalline structure of the elastomer in one direction. The orientation in one direction reduces creep in the strip to create a more durable seating surface, and also enables tuning the support characteristics of the strip to provide a desired support profile. In one embodiment, the ends of each strip, including the first and second attachment portions, are not oriented so that they remain more stable and less elastic than the oriented portions.

In one embodiment, the load bearing surface is configured to be mounted to a frame, and the attachment mechanism and frame include anti-rotation features that resist rotation of the attachment mechanism about the frame. In one embodiment, the attachment mechanism and frame are square, or otherwise shaped to resist rotation.

The present invention provides a comfortable, durable load bearing surface that it easily secured to a support structure. The molded elastomeric membrane is efficient to manufacture, and the orientation of the crystalline structure of the molded part provides comfort control and durability. The attachment portions eliminate the need to separate fasteners or attachment features on the support structure. Other features and advantages of the invention will become apparent to those skilled in the art upon review of the following detailed description, claims and drawings in which like numerals are used to designate like features.

Figure 1:
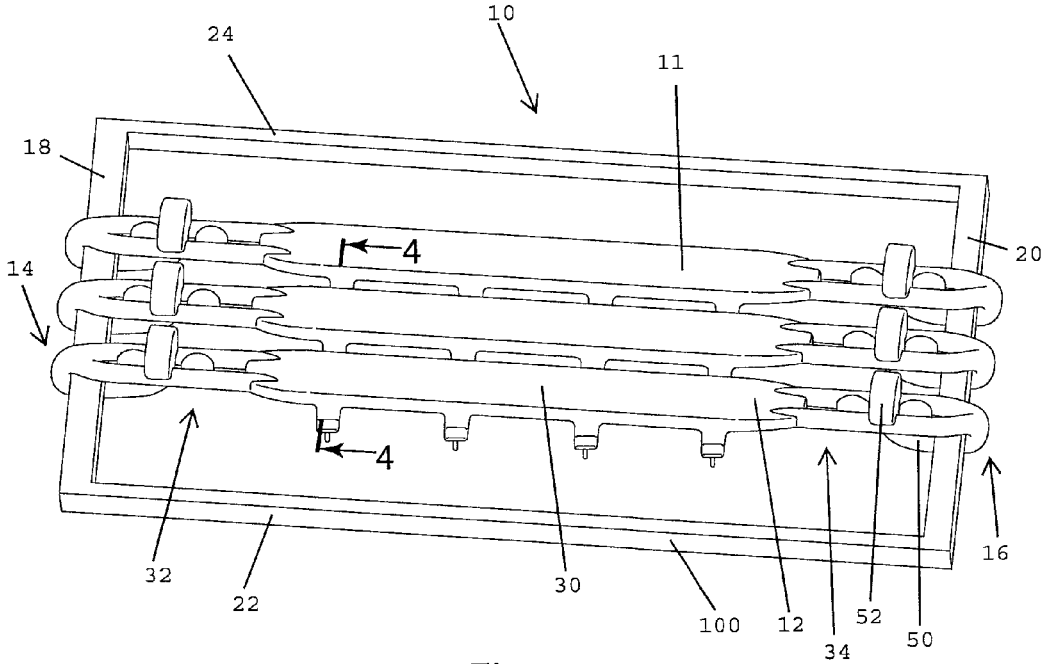
FIG. 1 is a perspective view of a portion of a load bearing surface attached to a portion of a support structure frame according to one embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE CURRENT EMBODIMENTS

I. Overview

A load bearing surface according to one embodiment of the present invention is shown in FIG. 1 and generally designated 10. The load bearing surface 10 shown in FIG. 1 is a molded membrane 11 that may be suspended from a support structure, such as a chair seat frame 100. In the illustrated embodiment, the membrane 11 is formed from a plurality of adjacent molded elastomeric strips 12. Each elastomeric strip includes first 14 and second 16 ends that wrap around frame members 18, 20 of the support structure 100 and attach to the strip itself to secure the strip to the support structure 100. The embodiment shown in FIG. 1 includes a portion of the load bearing surface 10, extending over a portion of a seat frame support structure 100. In one embodiment, the complete load bearing surface 10 for a seat frame 100 includes fourteen adjacent strips 12 extending over the entire seat frame 100, but the number of strips may vary from application to application. By way of disclosure, the present invention is described in connection with embodiments intended primarily for use in seating applications. The present invention is not, however, limited to use in seating applications, but may also be incorporated into other load bearing applications. The load bearing surface 10 can be tailored to attach to a variety of support structure frames and to support a variety of loads in a variety of different applications.

II. Structure

Figure 2:
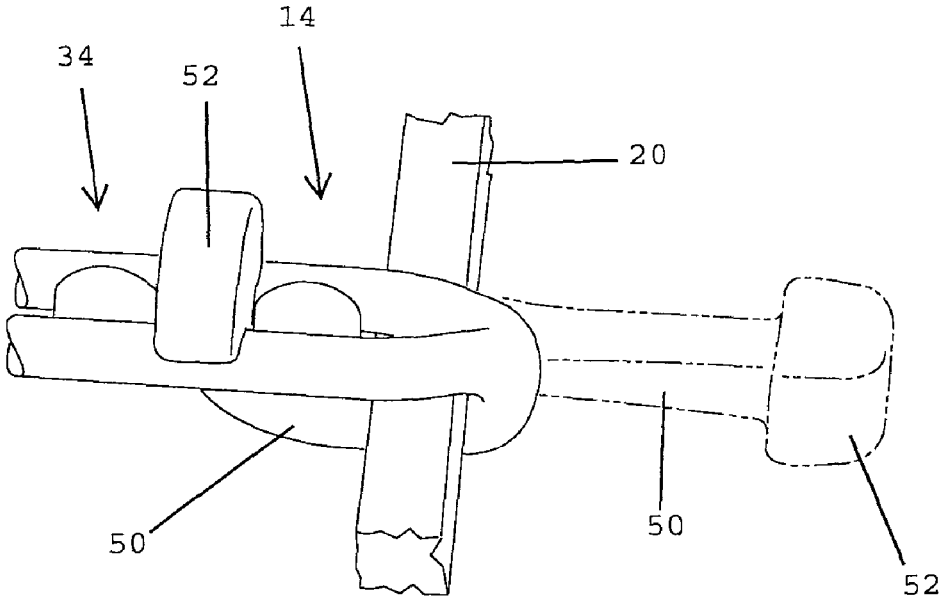
FIG. 2 is a close-up view of the attachment of a strip of the load bearing surface to a support structure frame according to one embodiment, with an unattached strip shown in phantom lines.
Figure 3:
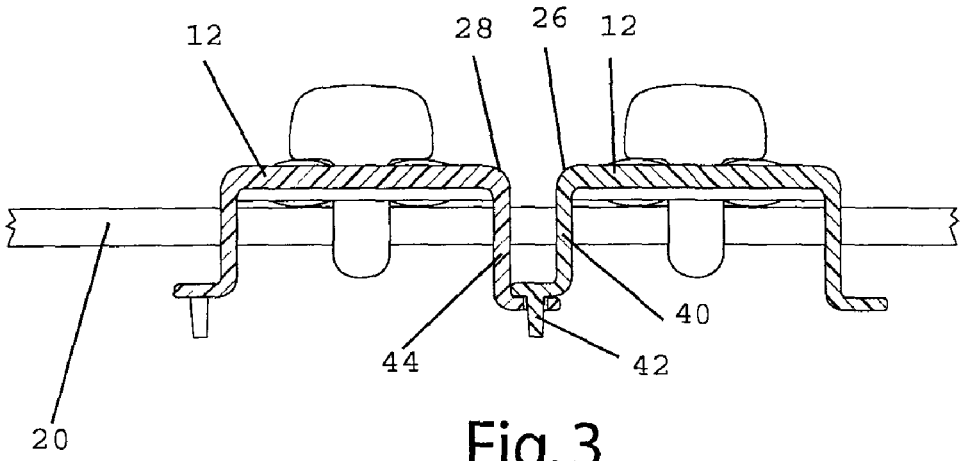
FIG. 3 is a cross-sectional view of two strips along line 4-4 in FIG. 1.
Figure 4:
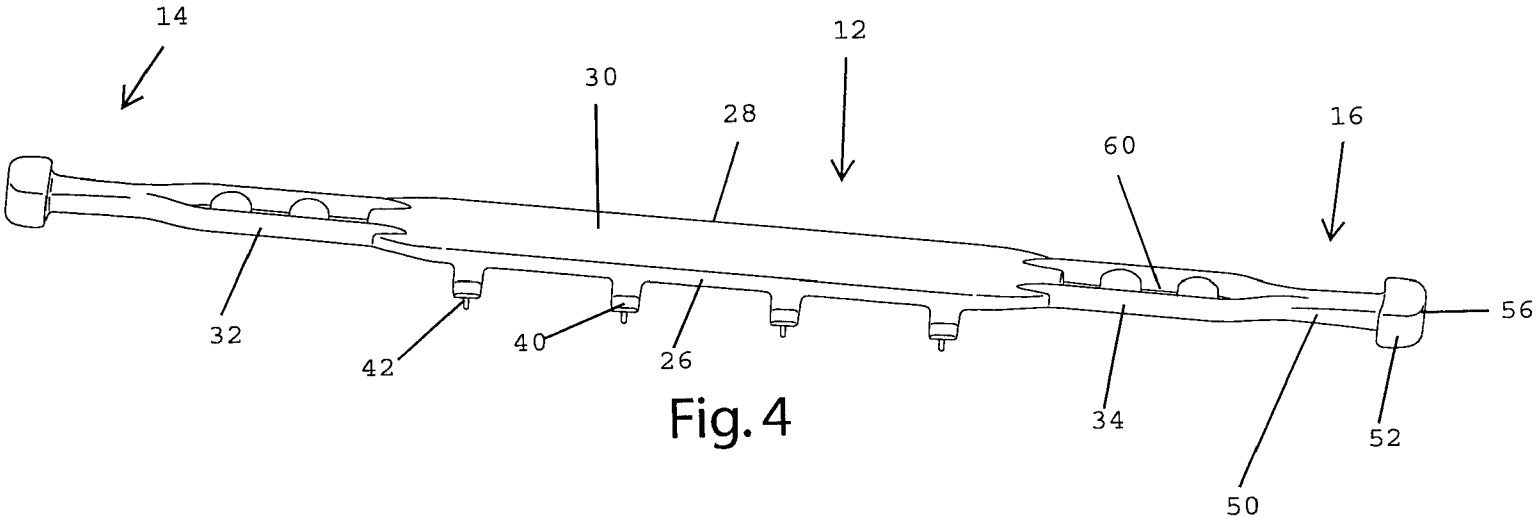
FIG. 4 is a front perspective view of a strap according to one embodiment of the present invention.
Figure 4A:
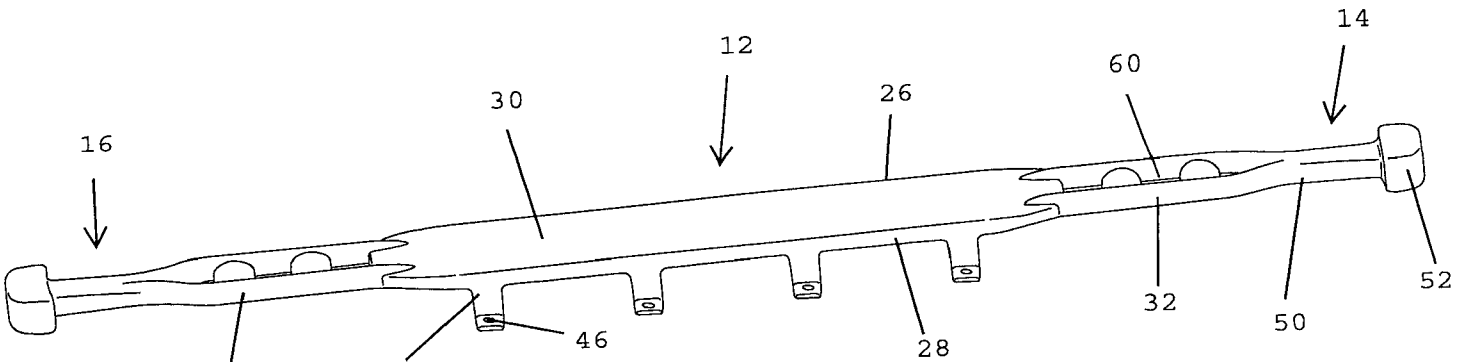
FIG. 4A is a rear perspective view of a strap according to one embodiment of the present invention.

FIG. 1 shows an exemplary support structure 100, including first and second side frame members 18, 20, a front frame member 22 and a rear frame member 24. As noted above, in one embodiment, the frame members 18, 20, 22 and 24 connect to form a seat frame portion of a chair. Alternatively, the frame members could be used in a variety of load bearing applications. As shown in FIGS. 1-3, the frame members 18, 20, 22, 24 each have a generally rectangular cross section, however, other shapes and designs are well known. The generally rectangular cross-section may help to reduce rotation of the attachment portions 32, 34 and ends 14, 16 of the strips 12 relative to the frame members 18, 20. Other cross sections, such as triangular, square or another irregular shape, may also accomplish this function. The size, shape and configuration of the frame may vary from application to application, and the load bearing surface 10 may be varied to mount to essentially any frame or other support structure. For instance the frame members may have a variety of lengths to accommodate any desired size of load bearing surface, and the frame members may cooperate to form any of a variety of shaped openings, such as the rectangular opening illustrated, or a circular or other shaped opening.

In the embodiment of FIG. 1, the load bearing surface 10 includes a molded elastomeric membrane 11 comprised of a plurality of elastomeric strips 12. The strips 12 are aligned adjacent to each other to cover the desired area defined by the support structure frame 100. The use of a plurality of strips 12 enables the formation of a load bearing surface 10 on a variety of different support structure frames of various sizes, simply by utilizing the necessary number of strips 12 to cover the desired area. As noted above, in one embodiment, the membrane 11 includes fourteen strips aligned adjacent to each other to comprise a load bearing seating surface, and sixteen strips aligned adjacent to each other to comprise a load bearing back support surface. Alternatively, however, any number of strips 12 could be used to form the desired size load bearing surface. In another embodiment, the membrane 11 could be molded as a single, unitary piece that is sized and shaped to cover the desired area.

In the illustrated embodiment, the strips 12 of membrane 11 are molded from a thermoplastic polyether ester elastomer block copolymer. Suitable materials of this type include that available from DuPont under the Hytrel® trademark, and that available from DSM under the Arnitel® trademark. A variety of alternative elastomers may be suitable for use in the present invention. The thickness of the molded membrane 11 will vary from application to application depending primarily on the anticipated load and the desired stiffness of the surface, but the support portion of the membrane 11 may have an average thickness prior to any desired orienting of approximately 20-40 mils in standard seating applications.

As shown in FIGS. 1-4A, each strip 12 includes a first end 14, a second end 16, a central portion 30, and first and second attachment portions 32 and 34. As illustrated, the central portion 30 is a generally flat, and includes first and second lateral edges 26 and 28. The thickness of the central portion 30, and the rest of the strip 12, can be varied to control the elasticity and support characteristics of the strip 12. The lateral edges 26 and 28 may include connectors to hold adjacent strips together when the strips 12 are attached to a frame 100. In the illustrated embodiment, the first lateral edge 26 of each strip 12 includes a plurality of spaced apart tabs 40, each having a pin 42 extending downwardly therefrom. The second lateral edge 28 of each strip 12 includes a plurality of tabs 44 that are spaced apart at the same intervals as the tabs 40 on the first lateral edge 26. Each tab 44 defines a hole 46 that is sized to receive one of the pins 42 extending from a tab 40 on an adjacent strip 12. As shown in FIG. 3, when strips 12 are aligned side-by-side on a frame 100, the pins 42 of one strip 12 extend through the holes 46 in the adjacent strip 12 to hold the strips 12 together, enabling a supportive load bearing surface.

As shown in FIGS. 1 and 2, the ends 14 and 16 and the attachment portions 32 and 34, are configured to secure the strip 12 to a frame 100. In one embodiment, each end 14, 16 includes a neck 50, and a head 52 extending from the neck 50. The head 52 is substantially wider than the neck 50 in a lateral direction, and the head 52 includes a rounded distal end 56. The attachment portions 32, 34 define an opening 60 that is sized such that the head 52 can be inserted through the opening and retained in the opening after insertion. In the illustrated embodiment, the attachment portions 32, 34 each include a plurality of openings 60, such that the head 52 can be inserted into one of the multiple openings 60 to accommodate for different sizes of frames. In an alternative embodiment, the size and shape of the head 52 and the size, location and number of openings 60 can be varied depending on the desired size and appearance of the strip 12 and the size of the frame 100.

Figure 5:
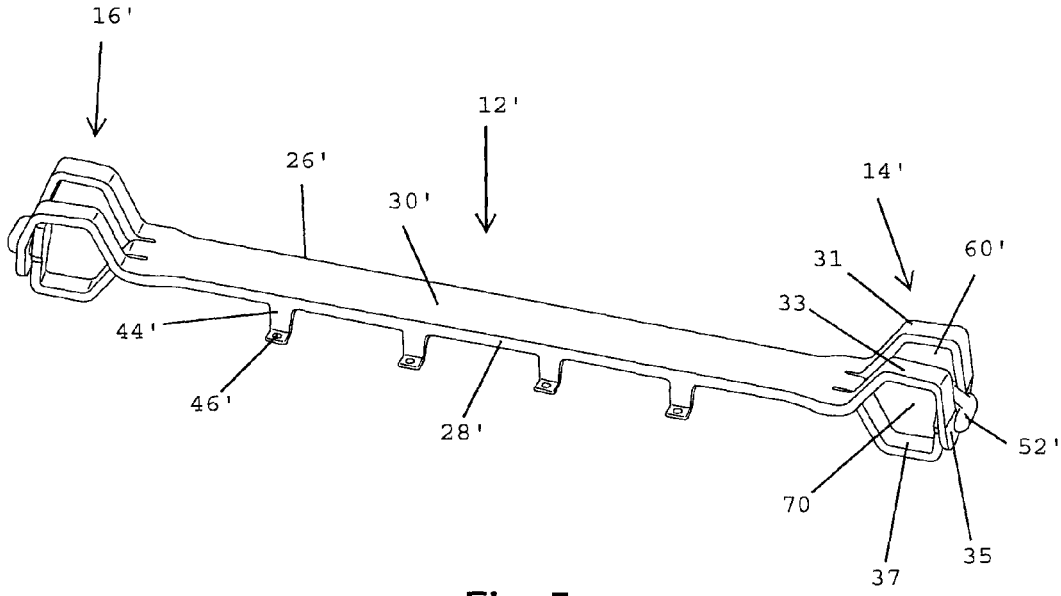
FIG. 5 is a front perspective view of a strap according to an alternative embodiment.

An alternative embodiment of the strip 12' is shown FIG. 5. In this embodiment, the strip 12' includes a central portion 30', and a pair of ends 14', 16' that form attachment portions. Each end 14', 16' includes a pair of upper fingers 31, 33 that are joined by a cross-member 35. The upper fingers 31, 33 and the cross member 35 form an opening 60' therebetween. A lower finger 37 extends from the central portion 30' between the upper fingers 31, 33. The lower finger 37 includes a tab 52' at its distal end that is sized such that it can be inserted into the opening 60', and then retained within the opening 60'. In the embodiment illustrated in FIG. 5, the upper fingers 31, 33 and lower finger 37 are molded to define a generally rectangular shaped opening 70 between them to receive a generally rectangular shaped frame member (not shown in FIG. 5). The generally rectangular shaped opening 70 reduces the chance that the ends 14', 16' will rotate with respect to the frame member extending through the opening when the strip 12' is mounted on the support structure. In the embodiment shown in FIG. 5, the strip 12' further includes first and second lateral edges 26', 28' including attachment tabs 44' with holes 46' extending from the second lateral edge 28', and attachment tabs with pins (not shown) extending from the first lateral edge 26'.

In one embodiment, at least a portion of each elastomeric strip 12 is oriented in one direction (i.e. the longitudinal direction of the strip) to provide creep resistance and elasticity in the direction of orientation. The strip 12 is oriented by increasing the alignment of the crystalline structure of the elastomeric strip 12 on a molecular level so that its support and other load bearing characteristics are altered. More particularly, a molded, un-oriented elastomeric strip typically includes a plurality of spherulites, which are created during the growth of the polymer by the formation of crystalline lamellae in helical strands radiating from a nucleation point. In an oriented strip, at least some of the spherulites are destroyed and the crystalline lamellae are aligned in one direction. Typically, the strip will be oriented to such a degree that the oriented strip 12 has materially different load bearing characteristics in the oriented direction than in other directions.

One method for orienting the strip 12 is through stretching. The amount of stretch required to obtain the desired alignment will vary from application to application, but in most applications the desired degree of alignment will occur when the membrane is stretched to roughly two times its original dimension. In one embodiment, the strip 12 is stretched beyond its elastic limit to a distance between approximately 3 to 8 times its original dimension, using approximately 1830 lbs. of force. Because the strip 12 is stretched beyond its elastic limit, it recovers to an intermediate dimension that is deformed from its original length. This deformation is non-recoverable, permanent deformation. As a result of this orientation and non-recoverable deformation, a degree of permanent deformation is removed from the oriented strip 12 such that when subsequent stresses on the oriented strip within the desired normal operating load are applied (for example in the range of approximately 100-300 lbs. for a seating application), the strip resists permanent deformation over time (i.e. creep).

Although the strip 12 may be oriented by stretching using a variety of methods and under a variety of conditions, a number of parameters may be controlled to provide the strip 12 with a desired amount of orientation. For instance, in one embodiment, the molded strip 12 is stretched within a short time, such as 10-15 minutes, after it is removed from the mold, so that the strip 12 is still warm when it is stretched. This reduces the force that is necessary to stretch and therefore orient the strip. In another embodiment, the strip is stretched at a rate of about 1 inch per second, until it has reached the desired deformation. A slow, controlled stretch aids in maintaining a uniform orientation across the strip. In another embodiment, a cyclic orientation may be performed, wherein the strip is oriented by stretching it to a first distance, then relaxed to a second, intermediate distance, and then stretched to a second distance greater than the first. The sequence may be repeated as many times as necessary to achieve the desired orientation. In one specific embodiment, the strip is stretched to 2 times its original length, relaxed to 1.5 times the original length, then stretched to 3 times the original length. A cyclic orientation process helps compensate for any irregularities within the strip material to provide a uniform stretch, because areas of greater or lesser stretch will even out after multiple cycles.

In addition to reducing creep, the stretching of a molded strip may be utilized to control the stiffness of the load bearing surface, and, ultimately, the comfort level of the surface. First, as noted above, orienting a strip in one direction provides an increase in elasticity in the material in that direction. The increased elasticity decreases the stiffness of the material in the oriented direction, and therefore affects the comfort of the material in locations of orientation. Second, as noted above, in use, the molded strip may be suspended from a chair seat frame. Typically, the strip is supported in tension on the frame with a desired amount of pre-load. Variations in the pre-load change the stiffness of the strip, and therefore affect the comfort level of the load bearing surface. In one embodiment, where the size of the frame and the original strip size are held constant, the stiffness characteristics of the material can be altered by changing the amount of permanent deformation given to the strip before it is attached to the frame. A greater amount of stretch during orientation provides a looser, less stiff load bearing surface when those strips are mounted to the support frame.

Although the elastomeric strips 12 may be oriented by stretching the strips 12, it may be possible in some application to orient the strips 12 using other processes. For example, it may be possible to orient certain materials by hammering or other forms of compression, rather than stretching the strips 12. It should be noted that many elastomeric materials, including molded Hytrel®, have essentially no elasticity and are susceptible to a high degree of creep when in a molded form. As noted above, the orientation process of the present invention causes a significant change in the properties of the elastomeric material. For example, orientation of the strips 12 increases the elasticity of the material and decreases its inherent susceptibility to creep.

In one embodiment, a portion of each strip 12 is oriented, and a portion of each strip 12 is left unoriented. In one embodiment, the central portion 30 of each strip 12 is oriented, and the attachment portions 32, 34 and ends 14, 16 are unoriented. This provides for an elastic, creep resistant central portion 30, while maintaining stability and less elasticity in the attachment portions 32, 34 and ends 14, 16 that are adapted to attach to the support frame 100. In one embodiment, the unoriented attachment portions 32, 34 and ends 14, 16 are formed from a thicker material than the oriented central portion 30. The central portion 30 is tuned to have the desired support and comfort characteristics, while the unoriented portions that will not actually form the contact portion of the seating surface, remain robust and durable simply due to their thickness.

III. Method

The manufacture and attachment of the load bearing surface 10, includes the general steps of (a) forming the elastomeric membrane 11, (b) attaching the membrane 11 to a support frame 100 by wrapping the necks 50 at each end 14, 16 around the frame 100 and inserting the heads 52 into an opening 60 in one of the respective attachment portions 32, 34, and (c) in the embodiment including multiple strips 12 forming the membrane 11, attaching adjacent strips 12 together to form a load bearing surface 10. In one embodiment, the forming of the elastomeric membrane 11 includes individually molding a desired number of elastomeric strips 12, and then orienting each strip 12 to align the crystalline structure of the strip 12. The orientation of the strip 12 may be done by holding the strip at the attachment portions 32, 34 and stretching the strip 12 to orient only the central portion 30. In the illustrated embodiment, the attachment of the membrane 11 to the support structure 100 includes positioning a first strip 12 on the support frame 100 with the neck 50 and head 52 of one end 14 extending over and beyond one of the frame members 20 (see phantom lines in FIG. 2), and with the neck 50 and head 52 of the opposite end 14 extending over an opposite frame member. The neck 50 and head 52 of each end are then flexed around their respective frame member, and inserted into an opening 60 in one of the attachment portions 32, 34 (as shown in solid lines in FIG. 2). Additional strips 12 are then added to the support frame, and attached to an adjacent strip, until the desired load bearing surface 10 is formed. In one embodiment, wherein at least a portion of the strips 12 are oriented by stretching, the timing of the orientation and attachment to the support frame 100 are controlled such that the strips are attached to the support frame within a short period of time after orientation, when they have not yet contracted into a final length. In this embodiment, the strips 12 are more easily attached to the frame, and they contract to a final, tightened state while attached to the frame.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A load bearing surface for attachment to a support structure having at least one frame member, the load bearing surface comprising:

a molded elastomeric membrane, formed from a plurality of separate elastomeric strips, each said strip including a first attachment portion adapted to wrap around a support structure frame member, and a second attachment portion adapted to receive and retain said first attachment portion, each said elastomeric strip including a third attachment portion for attaching to another one of said elastomeric strips such that the plurality of said elastomeric strips can be aligned adjacent to each other and secured together to form the load bearing surface.

2. The load bearing surface of claim 1 wherein said first attachment portion is a tab, and wherein said second attachment portion is a receptacle defined in said membrane that is adapted to receive and retain said tab.

3. The load bearing surface of claim 1 wherein each said elastomeric strip includes first and second lateral edges, said third attachment portion including a tab extending from said first lateral edge and a tab extending from said second lateral edge, one of said tabs including a protrusion extending from said tab, the other of said tabs defining a hole sized to receive said protrusion.

4. The load bearing surface of claim 1 wherein at least a portion of said molded elastomeric membrane is oriented to increase alignment of a crystalline structure of the elastomer in one direction.

5. The load bearing surface of claim 4 wherein said strip includes first and second ends, said ends each including said first and second attachment portions.

6. The load bearing surface of claim 5 wherein said ends are not oriented so that they remain more stable and less elastic than the oriented portions.

7. The load bearing surface of claim 6 wherein said strip includes a central portion extending between said first and second ends, wherein substantially all of said central portion is oriented to increase the alignment of the crystalline structure of said central portion of said elastomer in one direction.

8. A load bearing surface for attachment to a support structure having at least one frame member the frame member being rectangular in cross-section, the load being surface comprising:

a molded elastomeric membrane, said membrane including a first attachment portion adapted to wrap around the support structure frame member, and a second attachment portion adapted to receive and retain said first attachment portion, wherein at least one of said first and second attachment portions are shaped to resist rotation about the frame member, and wherein said first and second attachment portions cooperate to define a substantially rectangular section extending around said rectangular frame member.

9. A load bearing structure comprising:

a support structure including front and rear frame members and spaced apart side frame members defining a frame opening; and a plurality of molded elastomeric members suspended on said frame member to form a load bearing surface, said molded elastomeric members including first and second ends each including a first attachment portion and a second attachment portion, said first and second attachment portions cooperating to extend around a respective one of said frame members and attach to each other to support said molded elastomeric members on said frame member, some of said plurality of molded elastomeric members including a third attachment portion to interfit with others of said plurality of molded elastomeric members.

10. The load bearing structure of claim 9 wherein at least one of said plurality of molded elastomeric members includes a first lateral edge and a second lateral edge, and wherein said third attachment portion includes a first tab extending from said first lateral edge and a second tab extending from said second lateral edge, said first tab of one of said plurality of molded elastomeric members interfitted with said second tab of another one of said plurality of molded elastomeric members to connect said molded elastomeric members.

11. The load bearing structure of claim 9 wherein first attachment portion includes a tab and wherein said second attachment portion includes an opening defined in said molded elastomeric member, said first attachment member extending around said frame member, said tab extending through said opening such that it is retained in said opening.

12. The load bearing structure of claim 9 wherein at least a portion of said molded elastomeric member is oriented to increase alignment of a crystalline structure of said molded elastomeric member in one direction.

13. A method for manufacturing a load bearing surface comprising:

providing a support structure having a frame member;

providing at least two elastomeric members each including a first end and a second end, wherein each of said ends includes a first attachment portion and a second attachment portion, said second attachment portion defining an opening in said molded elastomeric member, at least one of said elastomeric members including a third attachment portion;

attaching said elastomeric members to said frame member by wrapping said first attachment portions of said ends around said frame member and extending said first attachment portions through said openings of said respective second attachment portions to attach said first attachment portions to said respective second attachment portions; and attaching said third attachment portion of said one of said elastomeric members to the other of said elastomeric members, whereby said elastomeric members form a load bearing surface suspended on said frame member.

* * * * *